US011019420B2

(12) United States Patent
Kara

(10) Patent No.: US 11,019,420 B2
(45) Date of Patent: May 25, 2021

(54) DEVICE AND METHOD FOR SOUND INTENSITY REGULATION IN EARMUFFS USING A POTENTIOMETER WITHIN A HOLLOW WHEEL

(71) Applicant: HONEYWELL INTERNATIONAL INC., Morris Plains, NJ (US)

(72) Inventor: Peter Kara, Morris Plains, NJ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 16/650,011

(22) PCT Filed: Oct. 3, 2017

(86) PCT No.: PCT/US2017/054835
§ 371 (c)(1),
(2) Date: Mar. 24, 2020

(87) PCT Pub. No.: WO2019/070229
PCT Pub. Date: Apr. 11, 2019

(65) Prior Publication Data

US 2020/0280790 A1 Sep. 3, 2020

(51) Int. Cl.
*H04R 1/10* (2006.01)
*H04R 5/033* (2006.01)

(52) U.S. Cl.
CPC ..... *H04R 1/1041* (2013.01); *H04R 1/1008* (2013.01)

(58) Field of Classification Search
CPC ..... H04R 1/10; H04R 1/1041; H04R 1/1008; H04R 1/1058; H04R 1/1066; H04R 25/60;
(Continued)

(56) References Cited

U.S. PATENT DOCUMENTS 3,306,991 A 2/1967 Wood
4,066,849 A * 1/1978 Chladil, Sr. ..... H04R 1/1041 381/371
(Continued)

FOREIGN PATENT DOCUMENTS

CN 101583060 A 11/2009
CN 205050657 U 2/2016
(Continued)

OTHER PUBLICATIONS

Communication Pursuant of Rules 161(1) and 162 for European Patent Application No. 17785127.6 dated Jun. 25, 2020, 3 pages.
(Continued)

*Primary Examiner* — Leshui Zhang
(74) *Attorney, Agent, or Firm* — Alston & Bird LLP

(57) ABSTRACT

Embodiments relate generally to systems and methods for containing a potentiometer within a wheel for use in an earmuff. An earmuff (for use with a headset) may comprise a housing configured to contain the internal elements of the earmuff; one or more sound producing elements located within the earmuff; a wheel at least partially exposed by an opening in the housing, configured to be rotated by a user; a potentiometer located within the wheel configured to detect and measure the rotation of the wheel by the user; and a processor configured to control the sound intensity output from the one or more sound producing elements based on receiving the detection from the potentiometer.

19 Claims, 9 Drawing Sheets

(58) Field of Classification Search
CPC ..... H04R 5/033; H01C 1/02; G04F 5/025; H01H 19/001
USPC .... 381/72, 73.1, 74, 75, 370, 371, 374, 376, 381/377, 378, 379, 383
See application file for complete search history.

(56) References Cited

U.S. PATENT DOCUMENTS

| | | | | |
|---|---|---|---|---|
| 4,117,444 | A | 9/1978 | Hildreth et al. | |
| 4,329,676 | A * | 5/1982 | McDonald | H01C 1/02 338/163 |
| 5,751,825 | A * | 5/1998 | Myers | G04F 5/025 381/118 |
| 7,318,654 | B2 | 1/2008 | McClanahan | |
| 9,398,361 | B1 | 7/2016 | Jaques et al. | |
| 2003/0024799 | A1* | 2/2003 | Jorgensen | H01H 19/001 200/175 |
| 2008/0232626 | A1* | 9/2008 | Ho | H04R 25/60 381/324 |

FOREIGN PATENT DOCUMENTS

| | | | |
|---|---|---|---|
| CN | 205921732 | U | 2/2017 |
| WO | 20131111298 | A1 | 5/2015 |

OTHER PUBLICATIONS

International Search Report of the International Searching Authority for PCT/US2017/054835 with dated Apr. 30, 2018.
Office Action and Search Report issued in Chinese Application No. 201780095573.9 dated Dec. 16, 2020, 19 pages.

* cited by examiner

DEVICE AND METHOD FOR SOUND INTENSITY REGULATION IN EARMUFFS USING A POTENTIOMETER WITHIN A HOLLOW WHEEL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hearing protection headsets may comprise large earmuffs attached to a headband to be worn over a wearer's head, holding the earmuffs over the wearer's ears. The earmuffs of a hearing protection headset may comply with hearing protection regulations, wherein the size, shape, and materials may be affected by the regulations. Hearing protection headsets may be worn for extended periods of time while the wearer is working in areas where hearing protection is required. Additionally, consumer headsets may comprise sound attenuation properties to prevent external noise from penetrating to a user's ear, while still allowing a user to hear sounds produced by a speaker within the headset. In some cases, the headset may allow the user to communicate with other users over a radio (or other) connection, and may therefore comprise microphones and speakers to allow for communication.

SUMMARY

In an embodiment, an earmuff for use with a headset may comprise a housing configured to contain the internal elements of the earmuff; one or more sound producing elements located within the earmuff; a wheel at least partially exposed by an opening in the housing, configured to be rotated by a user; a potentiometer located within the wheel configured to detect and measure the rotation of the wheel by the user; and a processor configured to control the sound intensity output from the one or more sound producing elements based on receiving the detection from the potentiometer.

In an embodiment, a method for controlling the sound intensity output by an earmuff ofa headset may comprise rotating a wheel located within a housing of the earmuff, wherein the wheel is at least partially exposed by an opening in the housing; due to the rotation of the wheel, rotating a rotor within a potentiometer, wherein the rotor and the potentiometer are located within the wheel; measuring the rotation of the rotor by one or more terminals of the potentiometer; communicating, by the potentiometer, the measured rotation to a processor, and controlling, by the processor, a sound intensity output by one or more sound producing elements of the earmuff, based on the measured rotation of the rotor.

In an embodiment, a headset may comprise a first earmuff comprising a housing configured to contain the internal elements of the earmuff; one or more sound producing elements located within the earmuff, a wheel at least partially exposed by an opening in the housing, configured to be rotated by a user; a potentiometer located within the wheel configured to detect and measure the rotation of the wheel by the user; and a processor configured to control the sound intensity output from the one or more sound producing elements based on receiving the detection from the potentiometer; a second earmuff; and a band connecting the first earmuff to the second earmuff.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
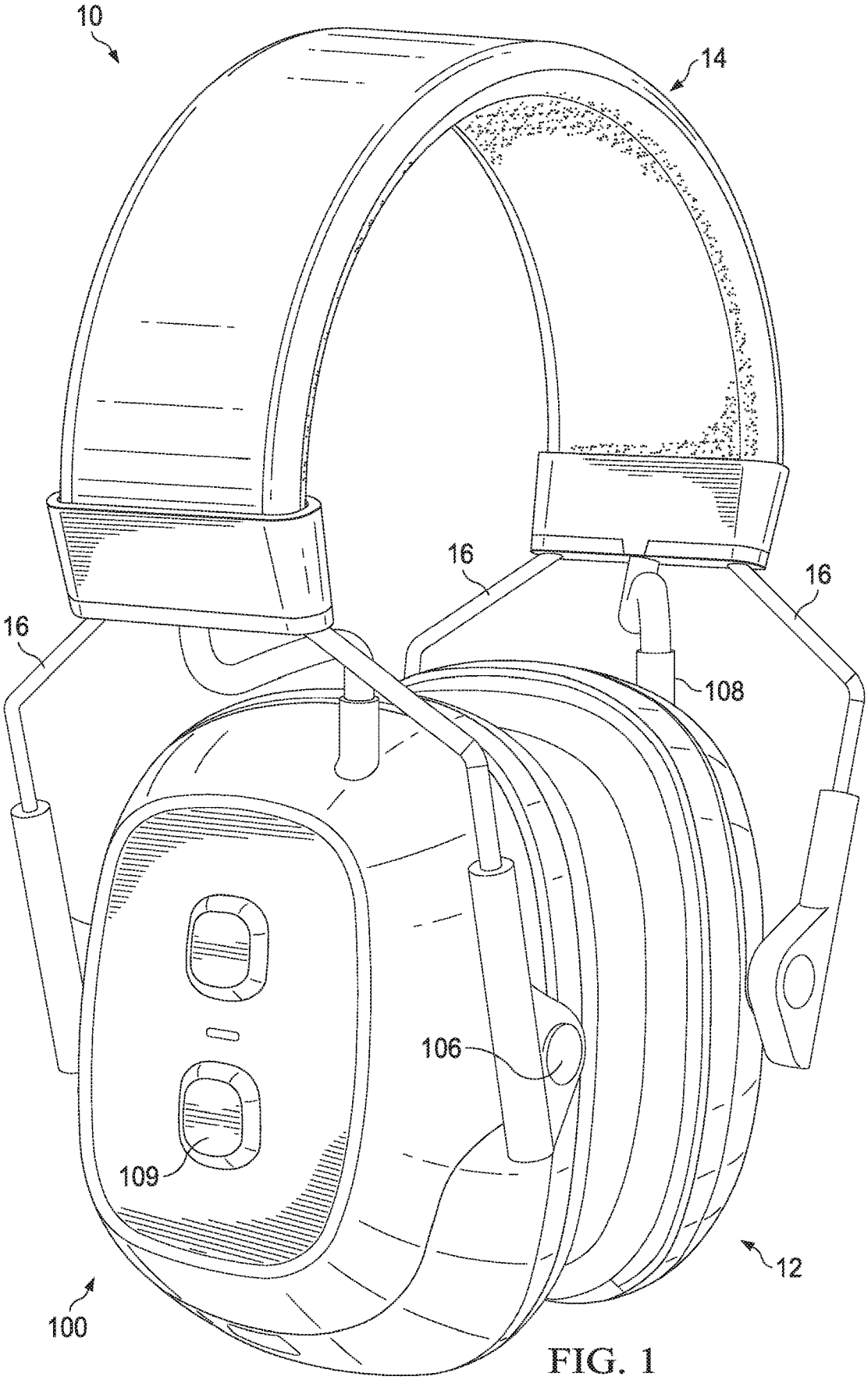
FIG. 1 illustrates a headset according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include systems and methods for containing a potentiometer within a wheel for controlling the sound intensity output by an earmuff. The earmuff may be a part of headset worn by a user to provide noise cancellation. The earmuff may comprise noise cancellation elements, communication elements, sound detection elements, sound producing elements, and/or other electronic input or control elements.

Analog circuitry, as well as some digital circuitry, often relies on variable resistors such as potentiometers. Potentiometers are relatively large when compared to the small parts that are used in portable or wearable electronics, so there may be challenges to using potentiometers in products with less internal space. And with respect to earmuffs, electronics often should be minimized in size, so they do not negatively impact sound/noise reduction. Potentiometers are also vulnerable to exposure to the outdoor environment, and may be damaged if exposed to a particularly harsh environment. Therefore, it may be important to protect the potentiometer from the environment, which may require additional sealing and/or waterproofing elements, typically further increasing the size of the potentiometer and surrounding elements.

Embodiments of the disclosure include a potentiometer that is located and/or sealed within a (hollow) wheel located at least partially within an earmuff. The potentiometer may be protected and internal space within the earmuff may be conserved by locating the potentiometer within the hollow wheel (e.g. by using the interior space/cavity of the hollow wheel to house the potentiometer, allowing both elements to fit within the space allocated just to the wheel). However, the potentiometer may be stationary (or fixed) with respect to the rotation of the wheel.

An ordinary or typical potentiometer may be used, which may lower the cost of the earmuff. By combining the potentiometer and wheel, the wheel may be larger than in other earmuffs (since additional space may have freed by the construction), improving the ability of the user to interact with the wheel, especially if they are wearing other protective equipment, such as gloves. Also, a potentiometer without a wiper stop may be used, where the potentiometer may have a longer use-life and increased precision.

Referring now to FIG. 1, an exemplary embodiment of an earmuff 100 is shown. The earmuff 100 may be incorporated into a headset 10 comprising a second earmuff 12, wherein the earmuffs 12 and 100 of the headset 10 are connected with a band 14. The earmuff 100 may comprise one or more connectors 106 wherein the connectors 106 may attached to the band 14 via bars 16. The earmuff 100 may comprise one or more buttons 109 and a wire connection (or input) 108. The headset 100 may comprise noise cancellation elements, communication elements, sound detection elements, and/or sound producing elements. In some embodiments, the wire connection 108 may communicate any control inputs from the first earmuff 100 to the second earmuff 12. For example, powering on the first earmuff 100 may also power on the second earmuff 12. As another example, controlling the sound intensity of the first earmuff 100 may also control the sound intensity of the second earmuff 12.

Figure 2A:
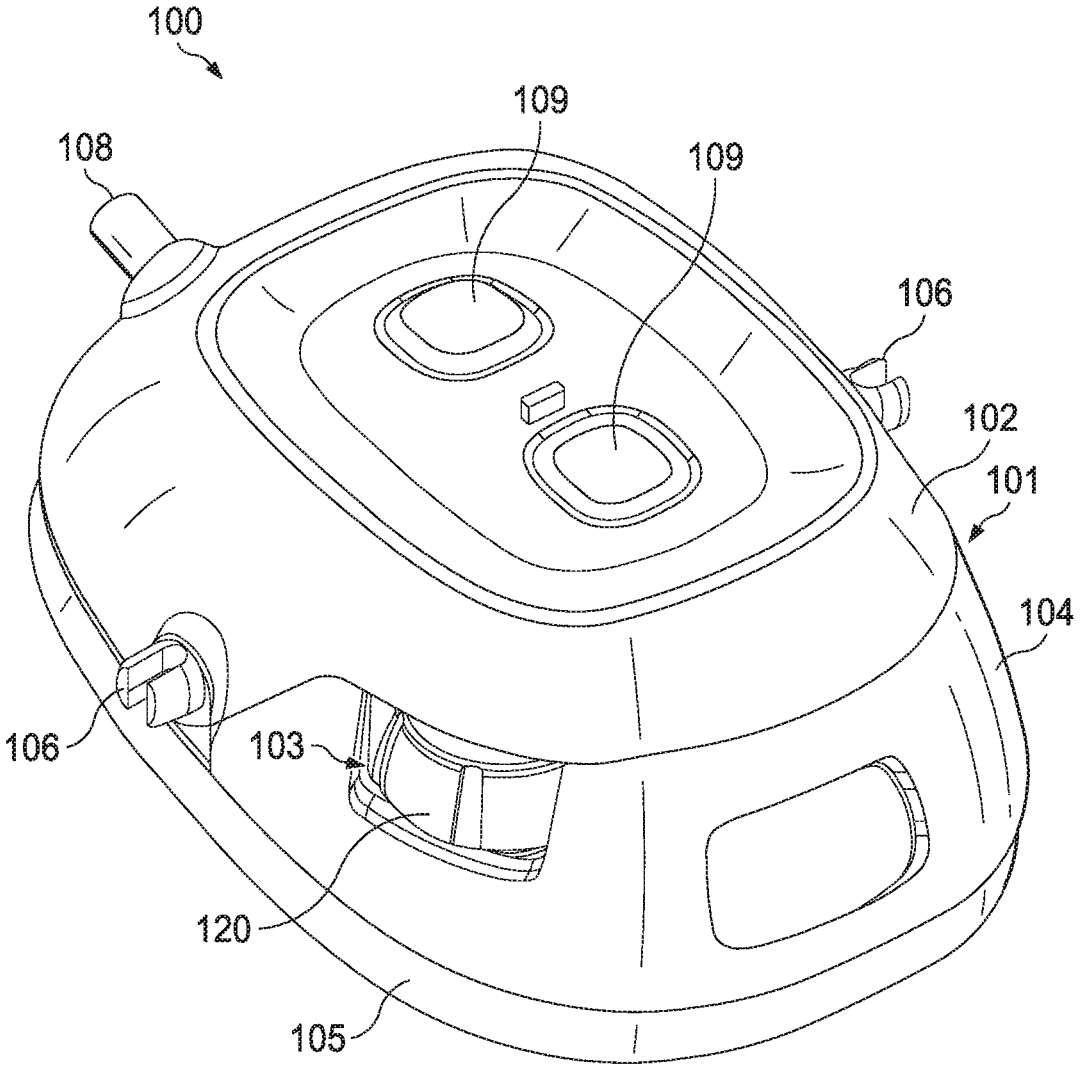
FIG. 2A illustrates a perspective view of an earmuff for use with a headset according to an embodiment of the disclosure.

FIG. 2A illustrates a detailed view of the earmuff 100. The earmuff 100 may comprise a housing 101 that is divided into a top housing 102 and a bottom housing 104. The top housing 102 may comprise one or more controls or buttons 109 configured to receive inputs from a user to control actions for the earmuff 100 and/or headset. The earmuff 100 may comprise one or more connectors 106 to allow for connection of the earmuff 100 to a headset. The earmuff 100 may comprise one or more inputs, including the wire connection 108, for wired connections to other elements of a headset. The earmuff 100 may also comprise a contact surface 105 for contacting the user's head and/or ear, and optionally surrounding the user's ear.

Figure 2B:
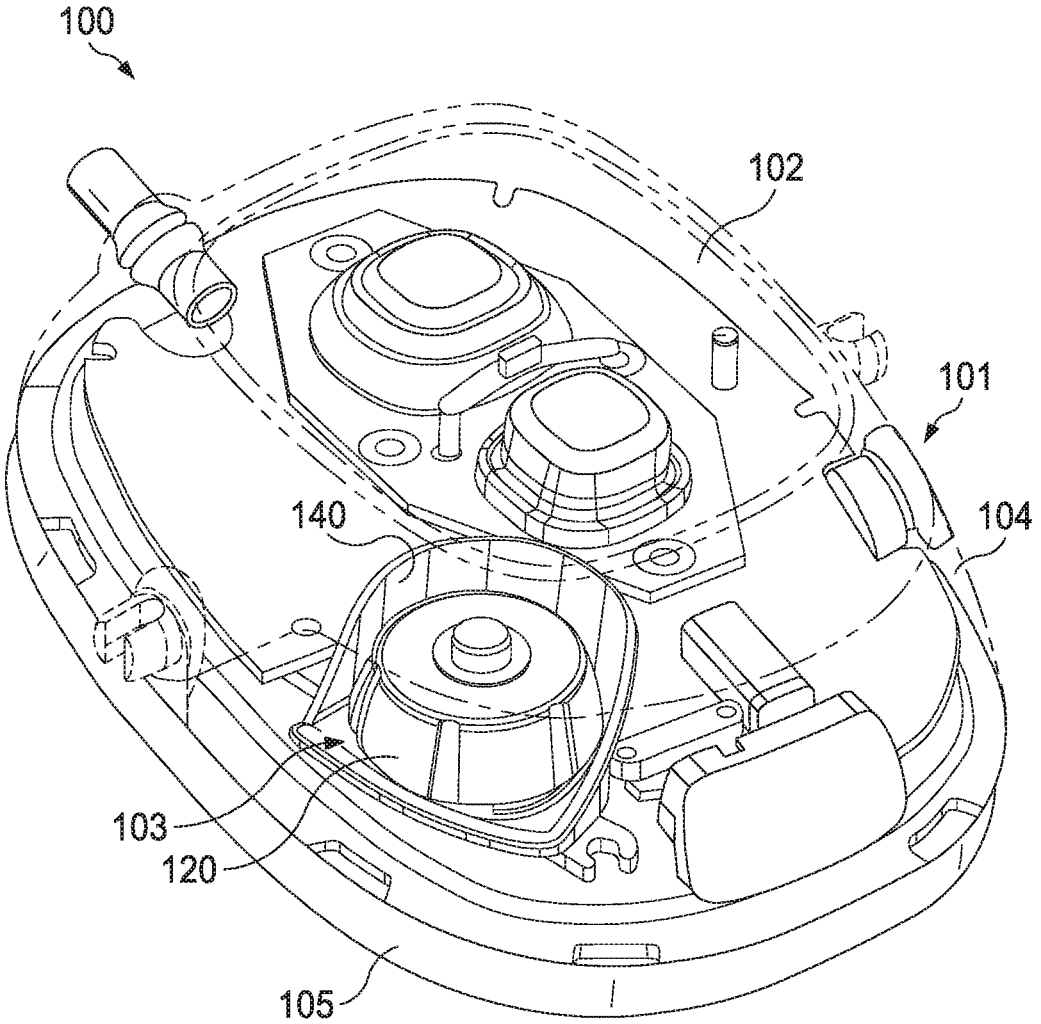
FIG. 2B illustrates a partially transparent perspective view of an earmuff for use with a headset according to an embodiment of the disclosure.

The earmuff 100 may comprise an opening 103 between the top housing 102 and bottom housing 104 (or in the housing 101, for example if the housing 101 is a single, integrated unit), where at least a portion of a wheel 120 may be accessible via the opening 103. The wheel 120 typically is configured to rotate about an axis (for example of a shaft 126), allowing rotation of the wheel 120 with respect to the housing 101. In FIGS. 2A-2B, the portion of the wheel 120 extending out of the housing 101 via the opening 103 may be located on a lateral side of the earmuff 100, for example in proximity to the bottom of the earmuff 100 and/or on the rear of the earmuff 100 (as it is worn by a user, for convenient access by a user's thumb). In some embodiments, the housing 101 has rounded or curved corners, and the wheel 120 is located and/or oriented so that its curvature approximately matches that of the earmuff housing 101. Such a feature reduces the potential of snags while still providing easy access to the wheel 120 as a central unit.

The wheel 120 may be configured to control sound intensity output (for example, for communication such as radio, entertainment and/or sound pass through) from the earmuff 100 based on adjustments by a user. The wheel 120 may be configured to rotate with respect to the housing 101. The wheel 120 may comprise an outer surface configured to allow for easy interaction for a user. For example, the wheel 120 may comprise one or more grooves in the outer surface of the wheel 120. As another example, the wheel 120 may comprise a sloped outer surface, wherein either the top of the wheel or the bottom of the wheel may extend further from the opening 103 in the housing 101. As another example, the wheel 120 may comprise a material that allows for gripping by a user's thumb and/or finger, and may allow for gripping when a user is wearing a glove.

FIG. 2B is the same view as FIG. 2A, where the top housing 102 and the bottom housing 104 are transparent. The earmuff 100 may comprise a wall 140 configured to contain the wheel 120. The wall 140 may seal the interior of the earmuff 100 from the external environment while allowing at least a portion of the wheel 120 to be exposed via the opening 103. The wall 140 may be shaped and sized to fit around the wheel 120 without contacting the wheel 120. The wall 140 may contact (and/or may be connected to) the top housing 102 and the bottom housing 104. The top housing 102 and the bottom housing 104 may interface with the wall 140 to provide an air-tight seal within the earmuff 100. In some embodiments, the wall 140 may be incorporated into the top housing 102 and/or the bottom housing 104. In some embodiments, the wall 140 may comprise one or more walls configured to fit together.

Figure 3:
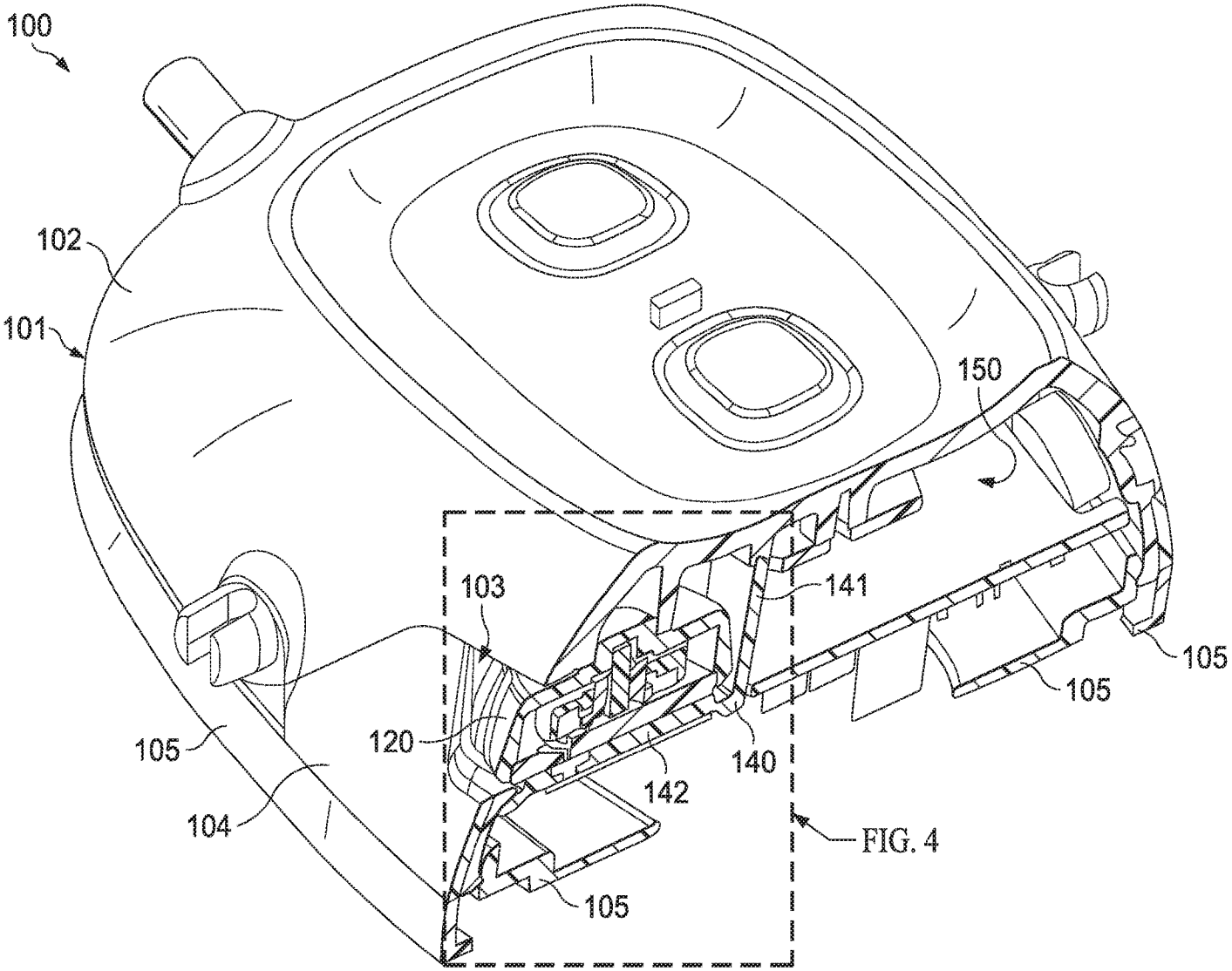
FIG. 3 illustrates a cross-sectional view of an earmuff for use with a headset according to an embodiment of the disclosure.

Referring now to FIG. 3, a cross-sectional view of the earmuff 100 is shown. The cross-section goes through the wheel 120. As described above, the earmuff 100 may have a top housing 102 and a bottom housing 104 with an opening 103 exposing the wheel 120 to be accessed by a user. As shown in FIG. 3, in some embodiments, the wall 140 may comprise a vertical portion 141 and a horizontal portion 142. In some embodiments, the wall 140 may comprise other shapes configured to surround the wheel 120 to provide an air-tight seal for the interior 150 of the earmuff 100 (which may improve sound/noise reduction by reducing transmission of sound into the earmuff 100 via air).

Figure 4:
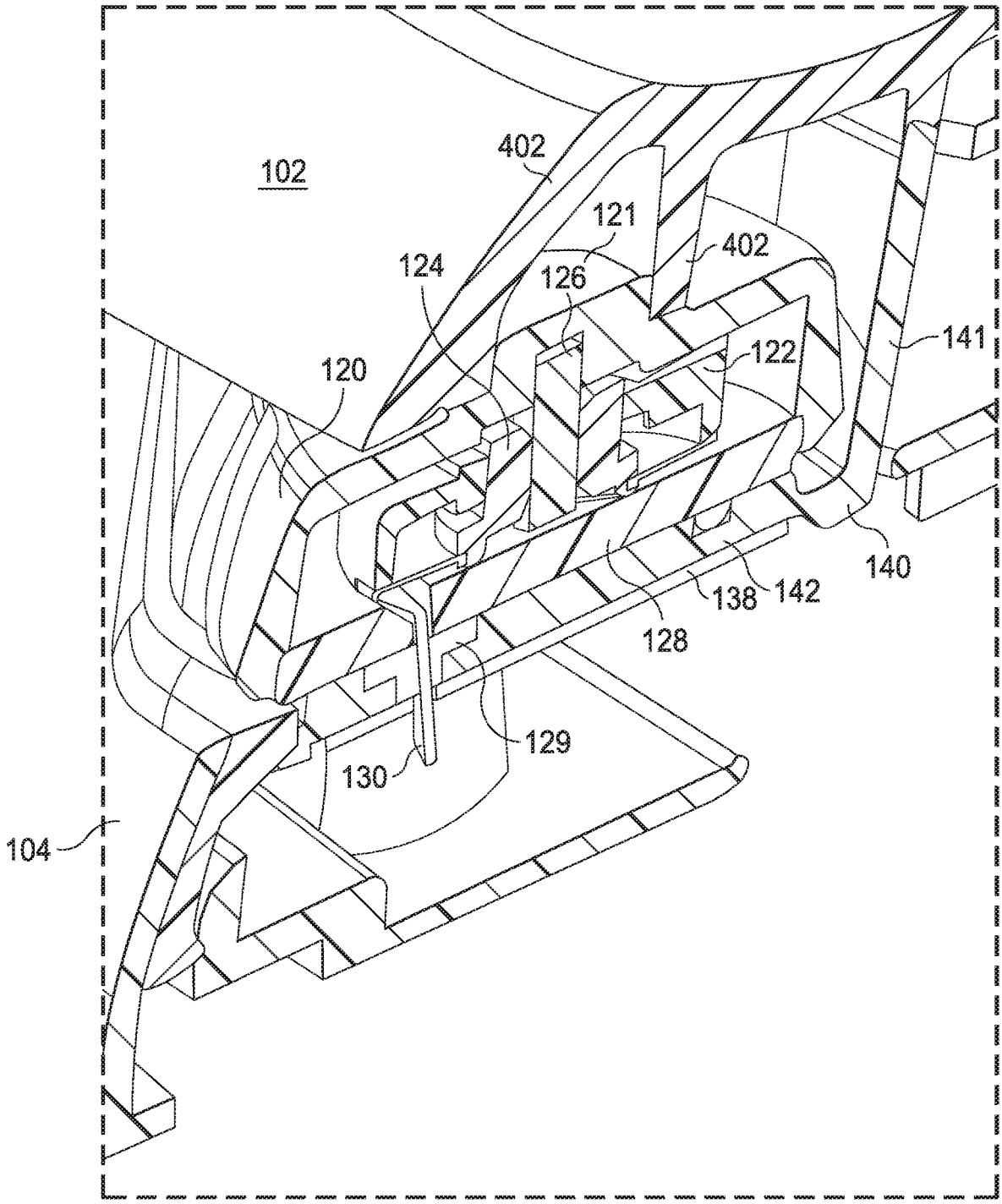
FIG. 4 illustrates a detailed cross-sectional view of a wheel for controlling sound intensity for use with an earmuff according to an embodiment of the disclosure.

Referring now to FIG. 4, a detailed cross-sectional view of the wheel 120 is shown, wherein the wheel 120 may comprise a potentiometer 122 located within the body of the wheel 120. The potentiometer 122 may be stationary with respect to the wheel 120 whenever the wheel 120 is rotated by a user (for example, so the wheel 120 may rotate/turn, but the potentiometer 122 does not). The wheel 120 may comprise a shaft 126 configured to rotate with the movement of the wheel 120 (e.g. the shaft 126 is rotationally attached to the wheel 120). In some embodiments, the shaft 126 may be attached to the wheel 120, while in other embodiments the shaft 126 may be integrated into the wheel 120, where the shaft 126 and wheel 120 are one continuous element. The potentiometer 122 may comprise a rotor 124 configured to interface with the shaft 126 (e.g. rotationally attached to the shaft 126) and the rotor also rotates with the movement of the wheel 120. In some embodiments, the shaft 126 may comprise a hexagonal shape and the rotor 124 may comprise a hexagonal opening configured to interface with the hexagonal surface of the shaft 126, such that the shaft 126 is rotationally attached to the rotor 124 by the corresponding shapes (e.g. interfacing surfaces). In other embodiments, any shape may be used to form the outer surface of the shaft 126, where the opening of the rotor 124 may comprise a corresponding shape. The potentiometer 122 may also comprise one or more terminals 130 configured to measure the movement of the rotor 124, and thereby control the sound intensity based on the electric signal corresponding to (and/or generated by) the movement of the rotor 124 (due to the movement of the wheel 120).

In some embodiments, the housing 101 and/or wall 140 may comprise a cover 128 configured to contain and protect the potentiometer 122, rotor 124, and shaft 126 and/or the wheel 120 may be open on one side (e.g. the side facing the cover 128). A (bottom) portion of the wheel 120 may interface with the cover 128. In some embodiments, the cover 128 may be stationary with respect to the wheel 120. The one or more terminals 130 may extend from the potentiometer 122 out of the wheel 120 to a processor 138 (which may also be called a printed circuit board (PCB) and/or may be incorporated into a PCB). The terminals 130 may communicate the detected movement of the rotor 124 to the processor 138, where the detected movement information may be used to control the sound intensity of the output of the earmuff 100. In other words, detected movement may be correlated to correspond to a specific change in sound intensity. In some embodiments, the terminal 130 may pass through an opening in the cover 128. In some embodiments, the terminal 130 may pass through a gasket 129 configured to seal the terminal 130 in place. The gasket 129 may be fitted into a portion of the wall 140 surrounding the wheel 120.

In some embodiments, the top housing 102 may comprise one more stabilizing walls 402 configured to hold at least a top portion 121 of the wheel 120 in place with respect to the top housing 102 (e.g. fixing the wheel's lateral x-y-z movement and/or position, while allowing rotation about its central axis). For example, the top portion 121 of the wheel 120 may be free to rotate within the stabilizing walls 402. In the embodiment of FIG. 4, the bottom portion of the wheel 120 may be fixed laterally by interaction with the cover 128 (e.g. with a bottom skirt of the wheel 120 interacting with the side edges of the cover 128). So for example, the bottom skirt/portion of the wheel 120 might contact the side edges of the cover 128 while allowing rotation of the wheel skirt with respect to the side edges of the cover 128. In some embodiments, the wheel 120 and the cover 128 may form at least a partial seal between them. In some embodiments, the interface between the wheel 120 and the cover 128 may be configured to prevent harmful substances from entering the cavity of the wheel 120 and damaging the potentiometer 122. In some embodiments, the interface between the wheel 120 and the cover 128 may form a water-tight seal. In some embodiments, the interface between the wheel 120 and the cover 128 may form an air-tight seal. In some embodiments, the interface between the wheel 120 and the cover 128 may comprise a lubricating material configured to facilitate the rotation of the wheel 120 with respect to the cover 128.

The potentiometer 122 within the wheel 120 may be protected by the wheel 120 and may therefore have a use-life of between approximately 100,000 to 150,000 cycles at the full angle of rotation. In some embodiments, the potentiometer 122 may comprise a diameter between approximately 5 and 30 mm. In some embodiments, the potentiometer 122 may comprise a diameter between approximately 10 and 20 mm. In some embodiments, the potentiometer 122 may comprise a diameter of approximately 15 mm. In some embodiments, the height of the wheel 120 may be between approximately 2 and 20 mm. In some embodiments, the height of the wheel 120 may be between approximately 5 and 15 mm. In some embodiments, the height of the wheel 120 may be approximately 10 mm.

The wheel 120 is typically hollow, with a cavity inside a circular e.g. thin cylinder) shell, and the potentiometer 122 fits within the cavity of the wheel 120. Thus, the wheel 120 is typically sized slightly larger than the potentiometer 122 (for example, the cavity within the hollow wheel 120 is slightly larger than the potentiometer 122, to allow for rotation of the wheel 120 with respect to the potentiometer 122, and the outer diameter and height/thickness of the wheel 120 is slightly larger than the cavity (e.g. based on wall thickness of wheel shell).

Figure 5A:
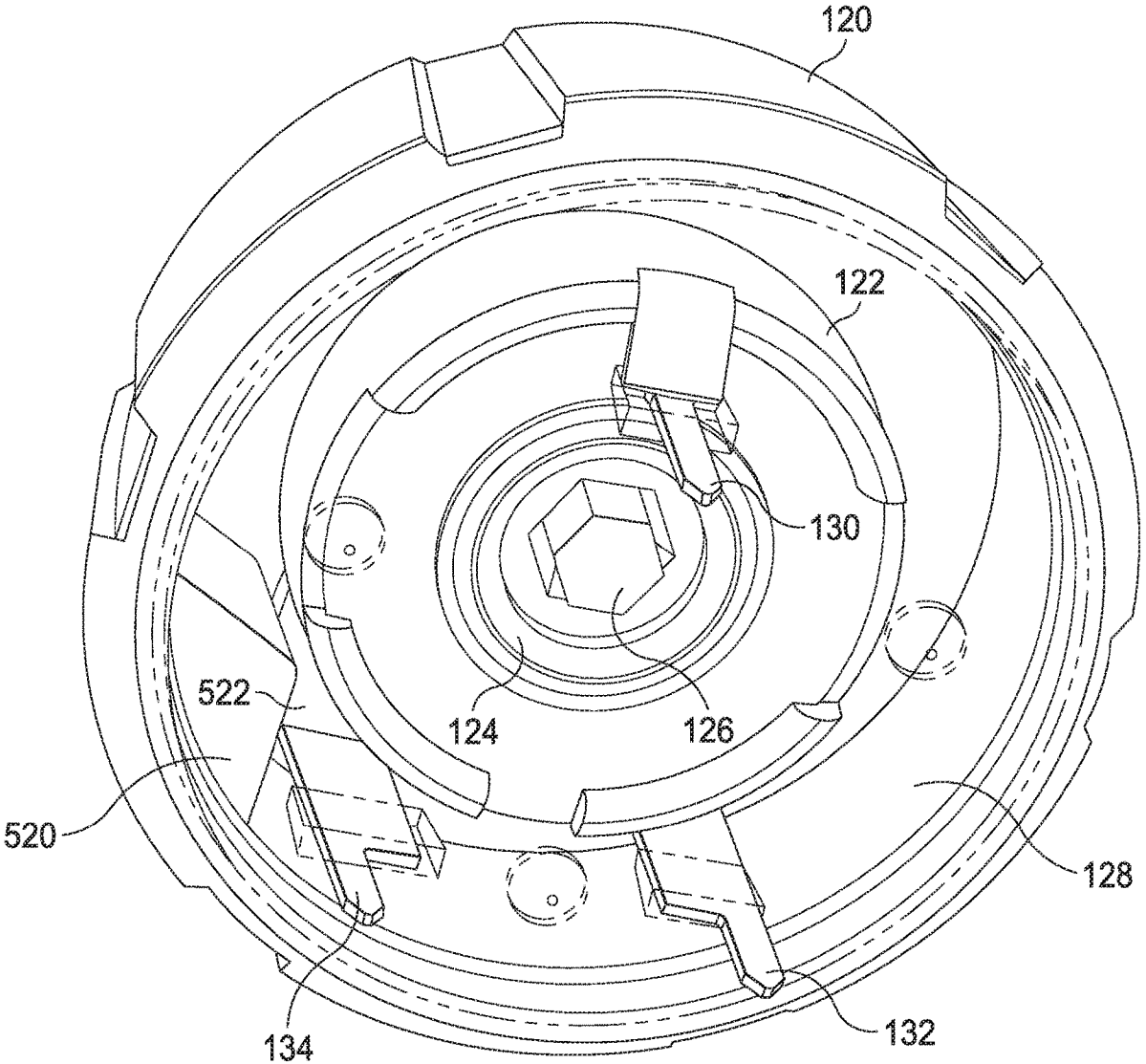
FIGS. 5A-5B illustrate bottom views of a wheel for controlling sound intensity for use with an earmuff according to an embodiment of the disclosure.
Figure 5B:
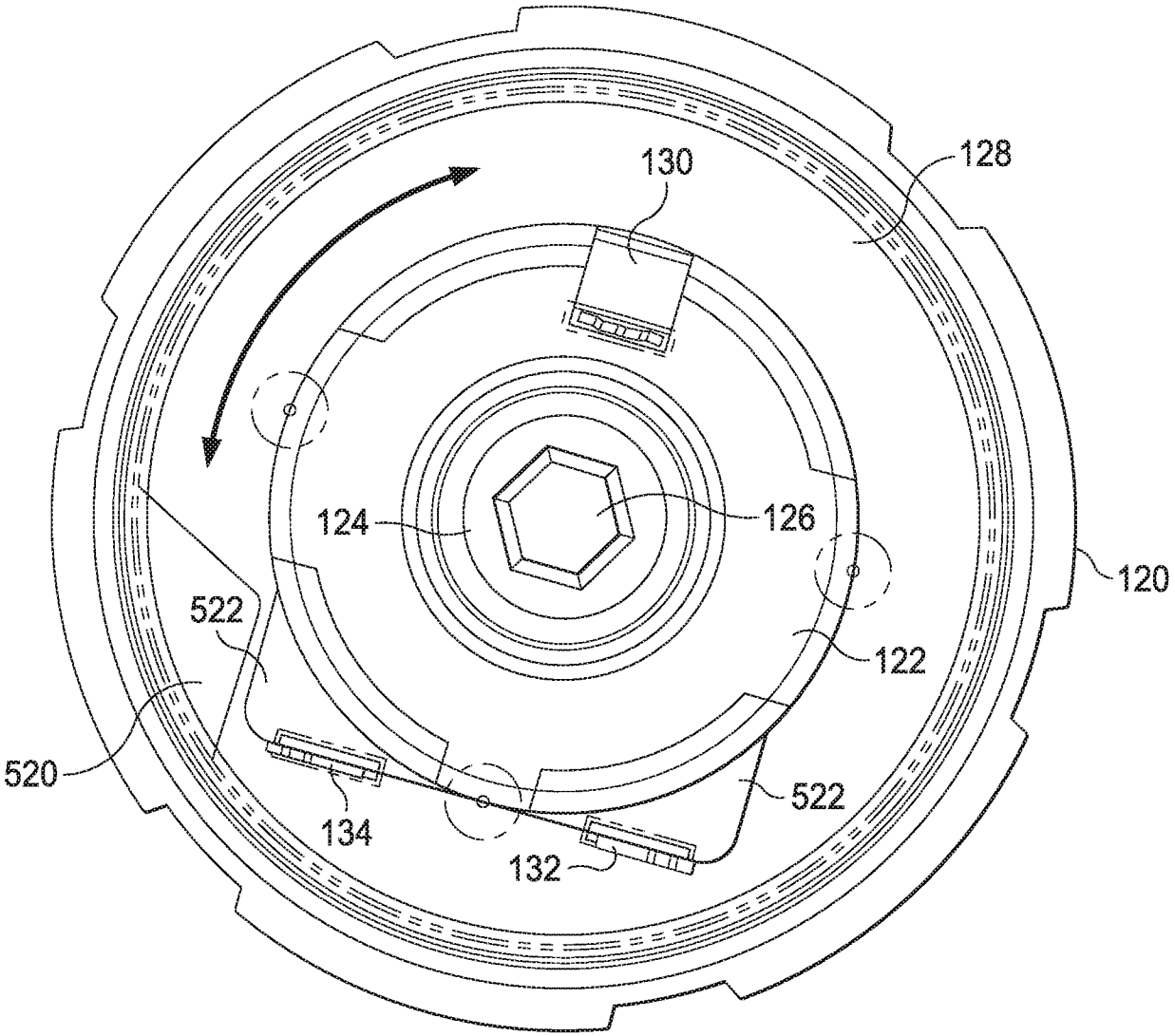

FIGS. 5A-5B illustrate bottom views of the wheel 120 and potentiometer 122, where the cover 128 is shown transparent (for ease of illustration). As described above, the rotor 124 may interface with the shaft 126. The one or more terminals 130, 132, and 134 may extend from the wheel 120 through the cover 128. The one or more terminals 130, 132, and 134 may be positioned to accurately detect the movement of the rotor 124 with respect to the potentiometer 122. In some embodiments, the wheel 120 may comprise a rotation stop 520 configured to bump up against one or more portions 522 of the potentiometer 122. The rotation stop 520 may prevent the wheel 120 (and therefore the shaft 126 and rotor 124) from over-rotating, which could damage these elements. In other words, the potentiometer 122 may comprise shaped portions 522 configured to interact with the rotation stop 520 of the wheel 120 to prevent over-rotation. The rotation stop 520 may also allow the potentiometer 122 to be used without an internal stop within the potentiometer itself while maintain the integrity of the potentiometer 122 for a high number of cycles (such as the approximately 100,000 to 150,000 cycles described above).

The potentiometer 122 is a three-terminal resistor with a sliding or rotating contact (the rotor 124) that forms an adjustable voltage divider. The potentiometer 122 is essentially a voltage divider used for measuring electric potential (voltage). Potentiometers are commonly used to control electrical devices such as volume controls on audio equipment. Potentiometers operated by a mechanism can be used as position transducers, for example, in a joystick. The potentiometer 122 may comprise a resistive element (or a first terminal 130), a sliding contact (rotor 124) that moves along the resistive element (or first terminal 130) (i.e. moves rotationally about the center axis of the first terminal 130), making good electrical contact with one part of it. The potentiometer 122 may comprise two other electrical terminals 132 and 134 at each end of the resistive element (first terminal 130), and a mechanism that moves the rotor 124 from one end to the other (i.e. interaction with the shaft 126 of the wheel 120), and a housing containing the resistive element (first contact 130) and rotor 124 (indicated by the potentiometer 122). In some cases, the rotor 124 may be referred to as a wiper.

Figure 6:
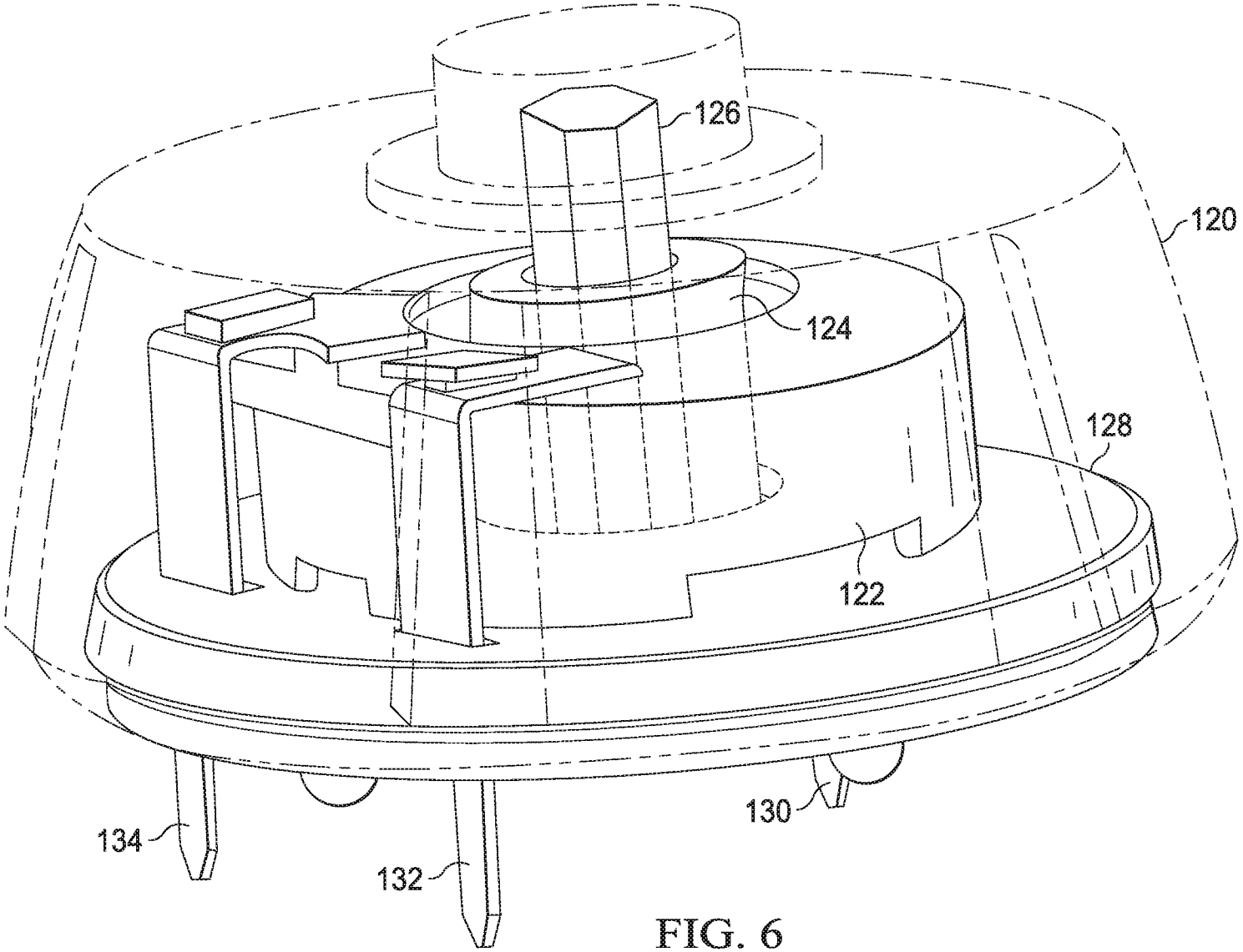
FIG. 6 illustrates a partially transparent side view of a wheel for controlling sound intensity for use with an earmuff according to an embodiment of the disclosure.

Referring to FIG. 6, the hollow shell of the wheel 120 is shown transparent (for illustration purposes), better illustrating the potentiometer 122, rotor 124, shaft 126, cover 128 and terminals 130, 132, and 134 located within the wheel 120.

Figure 7:
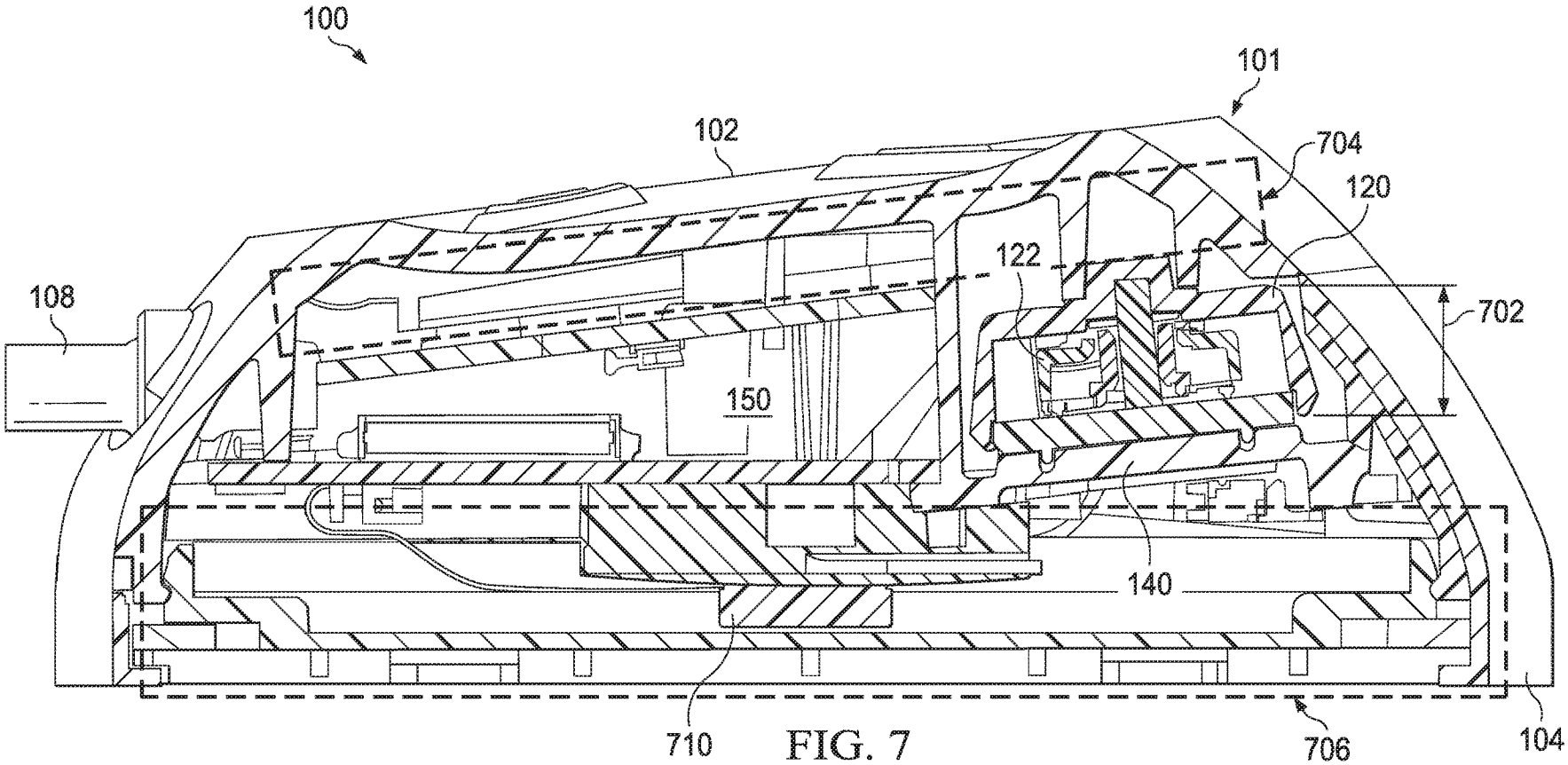
FIG. 7 illustrates a cross-sectional view of an earmuff comprising a wheel for controlling sound intensity according to an embodiment of the disclosure.

FIG. 7 illustrates another cross-sectional view of the earmuff 100 described above, wherein this cross-section is taken perpendicular to the cross-section of FIG. 3. The interior 150 of the earmuff 100 may be filled with essential electrical components. The space within the earmuff 100 may be limited and tightly controlled. Additionally, to provide sufficient noise cancellation, there may be some areas of the earmuff 100 where moving elements may not be located. As an example, the areas 704 and 706 shown in FIG. 7 illustrate "forbidden" areas of the earmuff, where the potentiometer 122 and/or the wheel 120 may not be located (for example, providing air space and/or space for foam material to provide effective noise reduction). Therefore, by locating the potentiometer within the shell created by the hollow wheel 120, space within the earmuff 100 is conserved. This may allow for smaller earmuffs that are still effective for noise reduction and/or allow for additional space for air space and/or foam for improved noise reduction, leading to earmuffs of improved Noise Reduction Rating (NRR), for example) In some embodiments, the height 702 of the wheel 120 may be between approximately 2 and 20 mm. In some embodiments, the height 702 of the wheel 120 may be between approximately 5 and 15 mm. In some embodiments, the height 702 of the wheel 120 may be approximately 10 mm.

Some elements of the earmuff 100 may not be placed within these "forbidden" areas 704 and 706 for one or more of the following reasons. The earmuff 100 (and headset) appearance may be negatively affected. The housing 101 may not provide enough space to accommodate certain elements in certain places. Technical problems may be encountered when elements are located within these areas. Manufacturing problems may be encountered when elements are located within these areas.

Additionally, as can be seen in FIG. 7, the earmuff 100 may comprise one or more sound producing elements 710 such as a speaker, where the sound intensity of the sound producing element(s) 710 may be controlled by the rotation of the wheel 120 (as described above). The earmuff 100 may comprise any number of sound producing elements, sound detection elements, electronic control elements, and noise cancellation elements.

Embodiments of the disclosure may include one or more methods of making an earmuff and/or wheel for use with an earmuff. The method may comprise placing a potentiometer within a hollow wheel. The method may comprise configuring the potentiometer to detect rotation of a rotor, wherein the rotor turns in response to turning of the wheel. The method may comprise mounting the wheel within an earmuff, where the wheel is at least partially exposed via an opening in a housing of the earmuff. The method may comprise electrically coupling the potentiometer to a processor, where the processor is configured to generate an output control signal for sound intensity based on the potentiometer input signal. The method may comprise electrically coupling the processor to one or more sound producing elements, where the sound producing elements are configured to generate an output based on the output control signal for sound intensity. The method may comprise forming a wall around the wheel, where the wall is configured to seal the interior of the earmuff while exposing at least a portion of the wheel.

Embodiments of the disclosure may include one or more methods of using a headset, earmuff, and/or wheel located within an earmuff. The method may comprise controlling the sound intensity output in the earmuff of a headset (for example, using any of the device/earmuff embodiments described above). The method may comprise rotating a wheel located within a housing of the earmuff, wherein the wheel is at least partially exposed by an opening in the housing. The method may comprise, due to the rotation of the wheel, rotating a rotor within a potentiometer, wherein the rotor and the potentiometer are located within the (hollow) wheel. The method may comprise measuring the rotation of the rotor by one or more terminals of the potentiometer. The method may comprise communicating, by the potentiometer, the measured rotation to a processor (based on voltage output from the potentiometer to the processor, for example). The method may comprise controlling, by the processor, a sound intensity output by one or more sound producing elements of the earmuff, based on the measured rotation of the rotor (e.g. by the voltage generated by the potentiometer due to rotation of the rotor). The method may comprise limiting the movement of the wheel by a stop located on the interior of the wheel configured to interact with a portion of the potentiometer. In some embodiments, communicating the measured rotation comprises communicating by the one or more terminals to the processor. In some embodiments, rotating the rotor comprises rotating a shaft extending through the rotor and interfacing with the rotor, wherein the shaft is attached to the wheel.

Having described various devices and methods herein, exemplary embodiments or aspects can include, but are not limited to:

In a first embodiment, an earmuff for use with a headset may comprise a housing configured to contain the internal elements of the earmuff; one or more sound producing elements located within the earmuff; a wheel at least partially exposed by an opening in the housing, configured to be rotated by a user; a potentiometer located within the wheel configured to detect and measure the rotation of the wheel by the user; and a processor configured to control the sound intensity output from the one or more sound producing elements based on receiving the detection from the potentiometer.

A second embodiment can include the earmuff of the first embodiment, wherein the potentiometer comprises a rotor configured to rotate with respect to the potentiometer.

A third embodiment can include the earmuff of the second embodiment, wherein the wheel comprises a shaft configured to interface with the rotor to cause the rotor to rotate with the rotation of the wheel.

A fourth embodiment can include the earmuff of the second or third embodiments, wherein the potentiometer further comprises one or more terminals configured to detect the motion of the rotor.

A fifth embodiment can include the earmuff of the fourth embodiment, wherein the one or more terminals are in communication with the processor.

A sixth embodiment can include the earmuff of any of the first to fifth embodiments, further comprising a wall surrounding the wheel, configured to seal the interior of the earmuff while exposing at least a portion of the wheel.

A seventh embodiment can include earmuff of the sixth embodiment, wherein the housing is configured to seal with the wall about the opening.

An eighth embodiment can include the earmuff of any of the first to seventh embodiments, wherein the wheel comprises a cover configured to secure the potentiometer within the wheel.

A ninth embodiment can include the earmuff of any of the first to eighth embodiments, wherein the potentiometer comprises a diameter of approximately 15 millimeters.

A tenth embodiment can include the earmuff of any of the first to ninth embodiments, wherein the wheel comprises a rotation stop located on the interior of the wheel configured to limit the rotation of the wheel by interacting with a portion of the potentiometer.

An eleventh embodiment can include the earmuff of any of the first to tenth embodiments, wherein the housing comprises one or more stabilizing walls configured to hold at least a portion of the wheel in place relative to the housing, while allowing the wheel to rotate with respect to the housing.

In a twelfth embodiment, a method for controlling the sound intensity output in an earmuff of a headset (for example, using any of the device/earmuff embodiments described above) may comprise rotating a wheel located within a housing of the earmuff, wherein the wheel is at least partially exposed by an opening in the housing; due to the rotation of the wheel, rotating a rotor within a potentiometer, wherein the rotor and the potentiometer are located within the (hollow) wheel; measuring the rotation of the rotor by one or more terminals of the potentiometer; communicating, by the potentiometer, the measured rotation to a processor (based on voltage output from the potentiometer to the processor, for example), and controlling, by the processor, a sound intensity output by one or more sound producing elements of the earmuff, based on the measured rotation of the rotor (e.g. by the voltage generated by the potentiometer due to rotation of the rotor).

A thirteenth embodiment can include the method of the twelfth embodiments, further comprising limiting the movement of the wheel by a stop located on the interior of the wheel configured to interact with a portion of the potentiometer.

A fourteenth embodiment can include the method of the twelfth or thirteenth embodiments, wherein communicating the measured rotation comprises communicating by the one or more terminals to the processor.

A fifteenth embodiment can include the method of any of the twelfth to fourteenth embodiments, wherein rotating the rotor comprises rotating a shaft extending through the rotor and interfacing with the rotor, wherein the shaft is attached to the wheel.

In a sixteenth embodiment, a headset may comprise a first earmuff comprising a housing configured to contain the internal elements of the earmuff; one or more sound producing elements located within the earmuff; a wheel at least partially exposed by an opening in the housing, configured to be rotated by a user; a potentiometer located within the wheel configured to detect and measure the rotation of the wheel by the user; and a processor configured to control the sound intensity output from the one or more sound producing elements based on receiving the detection from the potentiometer; a second earmuff, and a band connecting the first earmuff to the second earmuff.

A seventeenth embodiment can include the headset of the sixteenth embodiment, further comprising one or more wire connection elements connecting the first earmuff to the second earmuff.

An eighteenth embodiment can include the headset of the seventeenth embodiment, wherein the second earmuff comprises one or more sound producing elements, and wherein the processor is configured to control the sound intensity output from the one or more sound producing elements of the second earmuff.

A nineteenth embodiment can include the headset of any of the sixteenth to eighteenth embodiments, wherein the potentiometer comprises a rotor, and wherein the wheel comprises a shaft configured to interface with the rotor to cause the rotor to rotate with the rotation of the wheel.

A twentieth embodiment can include the headset of any of the sixteenth to nineteenth embodiments, wherein the first earmuff further comprises a wall surrounding the wheel, configured to seal the interior of the first earmuff while exposing at least a portion of the wheel.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An earmuff for use with a headset, the earmuff comprising:

a housing;

one or more speakers located within the earmuff;

a wheel at least partially exposed by an opening in the housing, configured to be rotated by a user, wherein the wheel comprises an internal cavity, wherein the wheel is enclosed within a wall;

a potentiometer located within the internal cavity and configured to detect and measure the rotation of the wheel by the user;

a cover, wherein the cover comprises a lubricating material at an interface between the wheel and the cover configured to facilitate the rotation of the wheel with respect to the cover, wherein the cover secures the potentiometer within the internal cavity;

a processor configured to control the sound intensity output from the one or more speakers based on receiving the detection from the potentiometer; and one or more forbidden areas, wherein a first forbidden area is defined by a space between a horizontal portion of the wall, a contact surface and a bottom housing.

2. The earmuff of claim 1, wherein the potentiometer comprises a rotor.

3. The earmuff of claim 2, wherein the wheel comprises a shaft configured to interface with the rotor to cause the rotor to rotate with the rotation of the wheel.

4. The earmuff of claim 2, wherein the potentiometer further comprises one or more terminals extending from the potentiometer to the processor.

5. The earmuff of claim 1, wherein the wall surrounding the wheel is configured to seal the interior of the earmuff while exposing at least a portion of the wheel.

6. The earmuff of claim 1, wherein the potentiometer comprising a diameter of approximately 15 millimeters.

7. The earmuff of claim 1, wherein the wheel comprises a rotation stop located on the interior of the wheel configured to limit the rotation of the wheel by interacting with a portion of the potentiometer.

8. The earmuff of claim 1, wherein the housing comprises one or more stabilizing walls configured to hold at least a portion of the wheel in place relative to the housing, while allowing the wheel to rotate with respect to the housing.

9. A headset comprising:

a first earmuff comprising:

a housing configured to contain the internal elements of the earmuff;

one or more sound producing elements speakers located within the first earmuff;

a wheel at least partially exposed by an opening in the housing, configured to be rotated by a user, wherein the wheel comprises an internal cavity, wherein the wheel is enclosed within a wall;

a potentiometer located within the internal cavity configured to detect and measure the rotation of the wheel by the user;

a cover, wherein the cover comprises a lubricating material at an interface between the wheel and the cover configured to facilitate the rotation of the wheel with respect to the cover, wherein the cover secures the potentiometer within the internal cavity;

a processor configured to control a sound intensity output from the speakers based on receiving the detection from the potentiometer;

one or more forbidden areas, wherein a first forbidden area is defined by a space between a horizontal portion of the wall, a contact surface and a bottom housing;

a second earmuff; and a band connecting the first earmuff to the second earmuff.

10. The headset of claim 9, further comprising one or more wire connection elements connecting the first earmuff to the second earmuff.

11. The headset of claim 10, wherein the second earmuff comprises one or more speakers, and wherein the processor is configured to control the sound intensity output from the one or more speakers of the second earmuff.

12. The headset of claim 9, wherein the potentiometer comprises a rotor, and wherein the wheel comprises a shaft configured to interface with a rotor to cause the rotor to rotate with the rotation of the wheel.

13. The headset of claim 9, wherein the wall is configured to seal the interior of the first earmuff while exposing at least a portion of the wheel.

14. An earmuff for use with a headset, the earmuff comprising:

a housing;

one or more speakers located within the earmuff;

a wheel at least partially exposed by an opening in the housing, configured to be rotated by a user, wherein the wheel comprises an internal cavity, wherein the wheel is enclosed within a wall;

wherein the wall seals an interior of the earmuff while exposing at least a portion of the wheel;

a potentiometer located within the internal cavity configured to detect and measure the rotation of the wheel by the user;

a processor configured to control the sound intensity output from the one or more speakers based on receiving the detection from the potentiometer; and one or more forbidden areas, wherein a first forbidden area is defined by a space between a horizontal portion of the wall, a contact surface and a bottom housing.

15. The earmuff of claim 14, wherein the potentiometer comprises a rotor.

16. The earmuff of claim 15, wherein the wheel comprises a shaft configured to interface with the rotor to cause the rotor to rotate with the rotation of the wheel.

17. The earmuff of claim 14, wherein the potentiometer further comprises one or more terminals extending from the potentiometer to the processor.

18. The earmuff of claim 14, further comprises a cover, wherein the cover comprises a lubricating material at an interface between the wheel wherein the cover secures the potentiometer within the internal cavity, and wherein the cover is configured to facilitate the rotation of the wheel with respect to the cover.

19. The earmuff of claim 14, wherein the wall surrounding the wheel is configured to seal the interior of the earmuff while exposing at least a portion of the wheel.

* * * * *